US005261325A

United States Patent [19]

Bengtsson

[11] Patent Number: 5,261,325

[45] Date of Patent: Nov. 16, 1993

[54] HAND STAMP

[75] Inventor: Lars Bengtsson, Falkenberg, Sweden

[73] Assignee: Unigraphics Marking Systems AB, Boras, Sweden

[21] Appl. No.: 863,560

[22] Filed: Apr. 3, 1992

[30] Foreign Application Priority Data

Apr. 4, 1991 [SE] Sweden ..... 9100994

[51] Int. Cl.[5] ..... B41K 1/00

[52] U.S. Cl. ..... 101/327; 101/333; 101/368

[58] Field of Search ..... 101/103, 104, 109, 110, 101/112, 327, 333, 334, 368, 405, 406

[56] References Cited

U.S. PATENT DOCUMENTS

| | | | |
|---|---|---|---|
| 1,179,979 | 4/1916 | Troup | 101/406 |
| 2,382,804 | 8/1945 | Morrison . | |
| 2,900,902 | 8/1959 | Becker . | |
| 4,029,012 | 6/1977 | Smith, III et al. | 101/368 |
| 4,594,943 | 6/1986 | Nettesheim et al. | 101/368 |
| 4,649,819 | 3/1987 | Voto et al. | 101/327 |
| 5,048,415 | 9/1991 | Shih | 101/333 |
| 5,111,745 | 5/1992 | Wilson | 101/103 |

FOREIGN PATENT DOCUMENTS

| | | | |
|---|---|---|---|
| 2408642 | 9/1974 | Fed. Rep. of Germany . | |
| 1427968 | 12/1964 | France . | |
| 545695 | 2/1974 | Switzerland . | |
| 545696 | 2/1974 | Switzerland . | |
| 2204832 | 11/1988 | United Kingdom | 101/405 |

OTHER PUBLICATIONS

Patent Abstracts of Japan vol. 4, No. 94 (M-19) (576) Jul. 8, 1980 and JP-A-55 051 578 (Masaru Arai) Apr. 14, 1980.

*Primary Examiner*—Edgar S. Burr
*Assistant Examiner*—Ren Yan
*Attorney, Agent, or Firm*—Nixon & Vanderhye

[57] ABSTRACT

Hand stamp including a stamp pad (10), a holder plate (11) supporting this, a shaft (15) connected the holder plate, a cover (17) which surrounds the holder plate (11) and the shaft (15) as well as a shaft knob (20) connected to the shaft, which against spring action can achieve a depression of the shaft (15) and the holder plate (11) with the stamp pad (10) connected to said shaft. To achieve a self adjusting contact pressure of the stamp pad the holder plate (11) is axially displaceable relatively the shaft (15), against the action of a spring (16).

8 Claims, 2 Drawing Sheets

HAND STAMP

BACKGROUND

I.Field of the Invention

The present invention refers to a hand stamp including an inked stamp pad.

II. Related Art and Other Considerations

Many hand stamps on the market having a hand stamp including an inked stamp pad, a holder plate supporting the stamp pad, a shaft connected to the holder plate, and a cover which surrounds the holder plate and the shaft. The cover has a first opening which exposes the stamp pad and a second opening through which the shaft extends. A shaft knob is connected to the shaft, which against spring action is depressable thereby pushing the holder plate and the stamp pad downwardly from the cover.

Most of the hand stamps on the market of the type stated above exhibit a mechanical adjusting means to adjust the position of the holder plate and thereby the position of the stamp pad relative to the cover. Thereby the contact pressure of the stamp pad can be varied, from a lower pressure for a new pad saturated with stamp ink to a higher pressure for a used pad, which might have been compressed after a periodical use. It has been shown that extremely few users are familiar with this mechanical adjusting means and therefore do not use the same, which naturally implies a lower utilisation factor of the stamp pad and the stamp ink.

The object of the present invention is to achieve a hand stamp of the above stated type, which is self adjusting as concerns the contact pressure of the stamp pad. This has been solved by the holder plate being axially displaceable relatively the shaft against the action of a spring.

SPECIFICATION OF THE DRAWINGS

In the following the invention will be described in closer detail with reference to an embodiment shown in the enclosed drawings.

Figure 1:
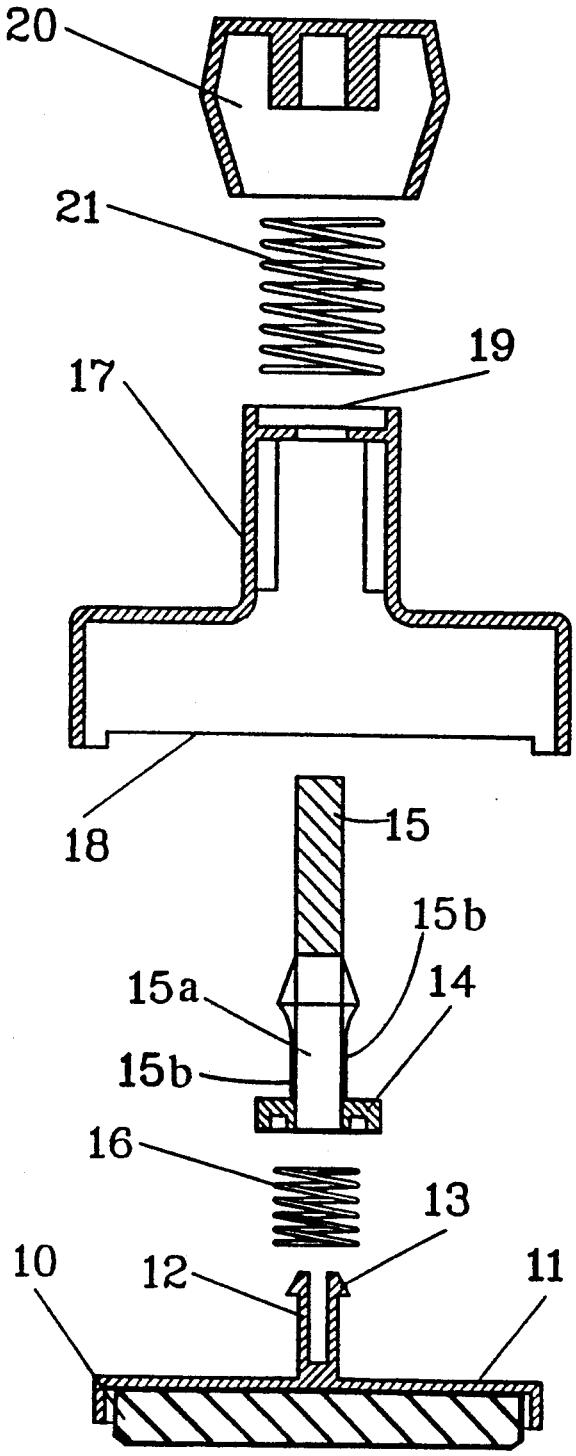

FIG. 1 is an exploded view of a hand stamp according to the invention.

Figure 2:
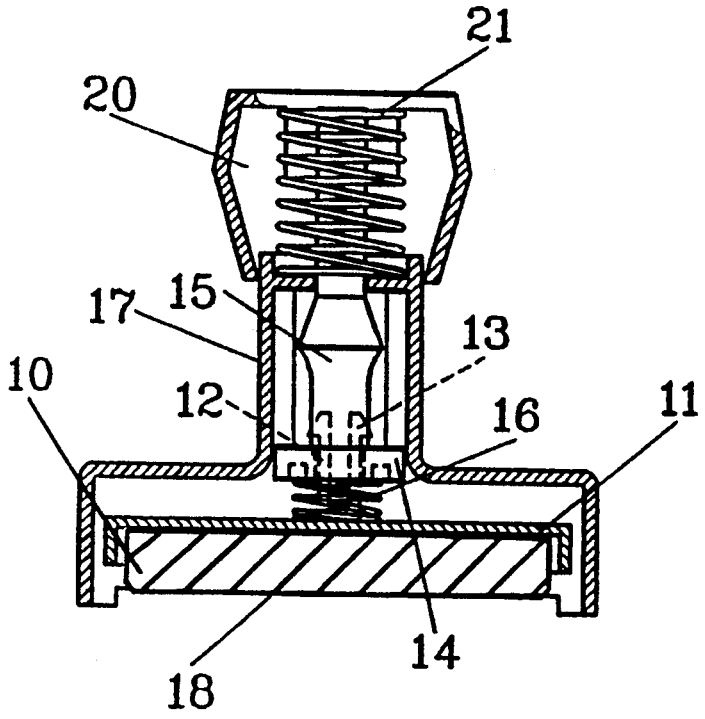

FIG. 2 discloses the hand stamp according to FIG. 1 in an assembled position.

Figure 3:
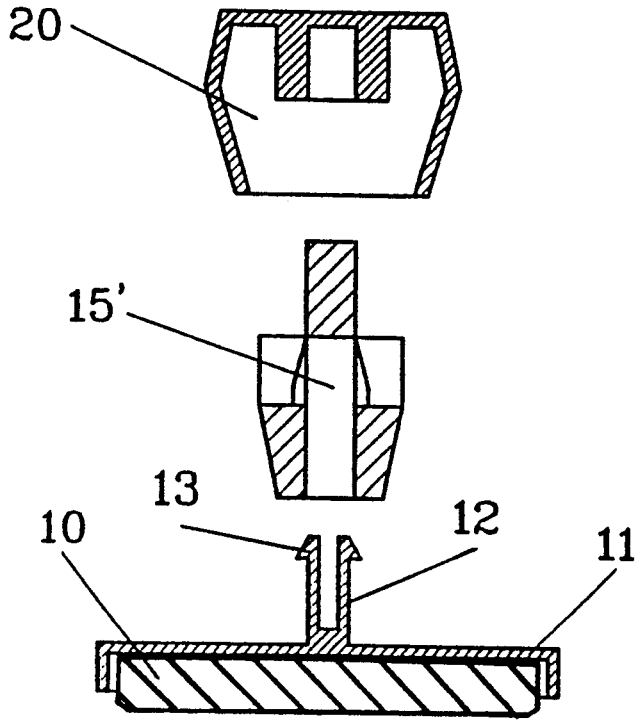

FIG. 3 is an exploded view of an alternative hand stamp without spring, but at least partly consisting of corresponding parts as the stamp according to FIG. 1.

SPECIFICATION OF EMBODIMENTS

The stamp according to FIG. 1 and 2 includes a stamp pad 10, which is supported by a holder plate 11. On its top the plate 11 has an attachment 12 in the shape of a pair of resilient tongues provided with shoulders 13 which can be snapped on behind shoulder surfaces 14 of a shaft 15. A coil spring 16 is clamped between the holder plate 11 and the shaft 15 and positioned about the attachment 12, which means that the holder plate 11 via its attachment 12 is resiliently pivoted to the shaft 15 in its axial direction.

As shown in the cross sectional view of FIG. 1, the shaft 15 has a central interior channel **15*a* into which the attachment 13 extends. The shaft 15 has radial slots 15*b* through which the shoulders 13 of attachment 12 extend for fitting over heel surface 14 of the shaft 15**.

A cover 17 surrounds the holder plate 11 and the shaft 15. The cover 17 has a lower opening 18 which exposes the stamp pad 10 and an upper opening 19 through which the upper end of the shaft 15 extends, which end is connected to a shaft knob 20. The shaft knob 20 overcomes the action of a coil spring 21 be when pressed downwards above the cover 17 and (thereby via the shaft 15) press out the holder plate 11 and stamp pad 10 from the cover 17.

The holder plate 11, at its center resiliently mounted to the shaft 15, that one always obtains a constant contact pressure and thereby a perfect print regardless of the thickness of the stamp pad 10. Besides the pressure is not influenced even if the stamp would be pressed downwards slightly inclined.

In FIG. 3 is shown a simpler type of hand stamp without spring action neither in the shaft knob 20 nor in the holder plate 11. It also lacks the cover 17. The shaft 15' is somewhat differently designed, e.g. shorter, compared to the shaft 15 according to FIG. 1. However the holder plate 11 with the attachment 12 as well as the shaft knob 20 is the same as according to FIG. 1 and 2.

By at least partly being able to use identical parts in the two different types of stamps the manufacture is simplified and rationalized.

The invention is naturally not limited to the embodiment shown but a number of variants are conceivable within the scope of the patent claims.

I claim:

1. A hand stamp comprising:

a stamp pad;

a holder plate which engages the stamp pad;

a shaft, the shaft having a shaft axis, the shaft also having a first end mounted on the holder plate and a second end;

a cover having a first opening and a second opening, the cover being positionable over the shaft and holder plate whereby the holder plate is extendable through the first opening and the second end of the shaft extends through the second opening;

a shaft knob mounted on the second end of the shaft;

means for biasing the holder plate toward the cover whereby the holder plate and stamp pad do not significantly extend though the second opening unless a force is applied to the shaft knob along the shaft axis;

means for resiliently mounting the first end of the shaft on the holder plate whereby the holder plate is displaceable relative to the shaft along the shaft axis, wherein the holder plate has at least one tongue extending therefrom in a direction parallel to the shaft axis, wherein the first end of the shaft has a central interior channel formed therein, and wherein the at least one tongue is accommodated in the central interior channel of the shaft.

2. The hand stamp of claim 1, wherein the holder plate has a pair of tongues formed thereon.

3. The hand stamp of claim 2, wherein the tongues are resilient tongues.

4. The hand stamp of claim 1, wherein the first end of the shaft has a heel formed thereon and at least one slot radially formed thereon above the heel and in communication with the central interior channel, and wherein the at least one tongue has a shoulder provided on a distal end, the shoulder fitting though the slot and being engagable with the heel of the shaft.

5. The hand stamp of claim 1, wherein the first end of the shaft has a heel formed thereon, and wherein a coil spring is captured between the heel and the holder plate.

6. A hand stamp comprising:

a stamp pad;

a holder plate which engages the stamp pad;

a shaft, the shaft having a shaft axis, the shaft having a first end mounted on the holder plate and a second end, the first end of the shaft having a central interior channel formed therein and a heel formed thereon, at least one slot being radially formed proximate the first end of the shaft above the heel and in communication with the central interior channel;

a cover having a first opening and a second opening, the cover being positionable over the shaft and holder plate whereby the holder plate is extendable through the first opening and the second end of the shaft extends through the second opening;

a shaft knob mounted on the second end of the shaft;

means for biasing the holder plate toward the cover whereby the holder plate and stamp pad do not significantly extend though the second opening unless a force is applied to the shaft knob along the shaft axis;

a coil spring captured between the heel of the shaft and the holder plate; and wherein the holder plate has a pair of resilient tongues extending therefrom in a direction parallel to the shaft axis, each tongue having a shoulder provided on a distal end thereof and fitting though the slot in the shaft and being engagable with the heel of the shaft.

7. A hand stamp comprising:

a stamp pad;

a holder plate which engages the stamp pad;

a shaft, the shaft having a shaft axis, the shaft having a first end mounted on the holder plate and a second end, the first end of the shaft having a central interior channel formed therein and a heel formed thereon, at least one slot being radially formed proximate the first end of the shaft above the heel and in communication with the central interior channel;

a cover having a first opening and a second opening, the cover being positionable over the shaft and holder plate whereby the holder plate is extendable through the first opening and the second end of the shaft extends through the second opening;

a shaft knob mounted on the second end of the shaft; and wherein the holder plate has at least one tongue extending therefrom in a direction parallel to the shaft axis, the tongue having a shoulder provided on a distal end thereof and fitting though the slot in the shaft and being engagable with the heel of the shaft, whereby the holder plate is displaceable relative to the shaft along the shaft axis.

8. The hand stamp of claim 7, wherein the tongue is a resilient tongue.

* * * * *